US007145111B2

(12) United States Patent
Hori

(10) Patent No.: US 7,145,111 B2
(45) Date of Patent: Dec. 5, 2006

(54) HEATER DRIVE CIRCUIT

(75) Inventor: Kenjiro Hori, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 10/809,360

(22) Filed: Mar. 26, 2004

(65) Prior Publication Data

US 2004/0188417 A1 Sep. 30, 2004

(30) Foreign Application Priority Data

Mar. 28, 2003 (JP) ..... 2003-092087

(51) Int. Cl.
*H05B 1/02* (2006.01)

(52) U.S. Cl. ..... 219/497; 399/334; 323/282

(58) Field of Classification Search ..... 219/482, 219/490, 497, 499, 503, 507, 508, 216, 619, 219/660–668, 672; 399/68–69, 88, 328–331, 399/320, 333–335; 323/222, 282, 285; 363/40, 363/98; 62/229

See application file for complete search history.

(56) References Cited

U.S. PATENT DOCUMENTS

| | | | | |
|---|---|---|---|---|
| 4,853,740 | A | 8/1989 | Ushio et al. | 355/319 |
| 5,321,235 | A * | 6/1994 | Makino et al. | 219/716 |
| 5,331,534 | A * | 7/1994 | Suzuki et al. | 363/20 |
| 5,676,363 | A | 10/1997 | Kishida et al. | 271/10.01 |
| 5,994,671 | A | 11/1999 | Suzuki et al. | 219/216 |
| 6,037,576 | A * | 3/2000 | Okabayashi et al. | 399/330 |
| 6,244,061 | B1 * | 6/2001 | Takagi et al. | 62/229 |
| 6,367,273 | B1 * | 4/2002 | Takagi et al. | 318/802 |
| 6,373,232 | B1 * | 4/2002 | Mano et al. | 219/216 |
| 6,628,905 | B1 | 9/2003 | Hori et al. | 399/38 |
| 6,868,249 | B1 * | 3/2005 | Kinouchi et al. | 399/328 |
| 6,930,293 | B1 * | 8/2005 | Matsuo et al. | 219/664 |
| 2004/0179874 | A1 * | 9/2004 | Kinouchi et al. | 399/328 |

FOREIGN PATENT DOCUMENTS

| | | |
|---|---|---|
| JP | 5-281864 | 10/1993 |
| JP | 61-35555 | 5/1994 |
| JP | 6-230702 | 8/1994 |
| JP | 11-195477 | 7/1999 |
| JP | 2000-150110 | 5/2000 |
| JP | 2001-312178 | 11/2001 |
| JP | 2002-123122 | 4/2002 |

* cited by examiner

*Primary Examiner*—Tu Hoang
(74) *Attorney, Agent, or Firm*—Fitzpatrick, Cella, Harper & Scinto

(57) ABSTRACT

A heater control circuit performs ON/OFF control of a switching converter for a FET so that an AC line current supplied from a DI terminal becomes approximate to a predetermined value. A current flowing to a heater is stabilized to a predetermined value, and, unless an AC line voltage fluctuates, electric power supplied to the heater is held to a predetermined value. With this contrivance, in an image forming apparatus including a fixing heater (heating heater), a printing speed of the image forming apparatus can be improved to the greatest possible degree under such a condition that a total amount of utilizable electric power is restricted.

20 Claims, 9 Drawing Sheets

101
102
AC LINE FILTER
103
104
PRINTER CONTROLLER
105
106
107
108
109
110
111
112
113
114
~A
~B
RECTIFICATION CIRCUIT
GND
115
VCC1
OUT
HEATER CONTROL CIRCUIT
DI
DV
GND
RET
FDRV
116
VCC1
VIN
VOLTAGE DETECTING CIRCUIT
VOUT
GND
A+
A-
117
118
DC-DC CONVERTER
INPUT
OUTPUT
119
DC-DC CONVERTER
INPUT
OUTPUT
AUXILIARY POWER SUPPLY +
AUXILIARY POWER SUPPLY -
FDRV
RET

HEATER DRIVE CIRCUIT

BACKGROUND OF THE INVENTION

1. Field of the Invention

The present invention relates to a heater drive circuit for driving a fixing heater used for a laser beam printer and an electrophotographic copying machine.

2. Related Background Art

A glass tube heater in which a glass tube is filled with a gas and an exothermic conductor is heated in this gas environment, has hitherto been often used as a heating means of a fixing heater utilized for a laser beam printer and an electrophotographic copying machine. In particular, a so-called halogen heater involving the use of a halogen gas as the above gas is widely utilized. This glass tube heater functions electrically as a non-linear device and has such a characteristic that an electric resistance is low in a state where a temperature of the heater is low and rises when the heater is heated. This characteristic leads to an increase in rush current when heater is switched ON/OFF.

Generally, TRIAC defined as an AC (Alternate Current) ON/OFF device is broadly utilized as a device for driving the heater. A thermistor for detecting a temperature is attached to a fixing unit, and a device for controlling the fixing unit switches ON/OFF the TRIAC in a way that detects a temperature of the thermistor. None of problems arise while the heater is kept heated, however, if switched ON in state where the heater is cooled, an excessive current flows to the heater and the TRIAC due to the non-linear characteristic of the heater. Incidentally, the rush current of the heater reaches a level that is approximately ten times as much as the current in a steady state.

The rush current at the heater ON-time naturally flows also to an AC power supply line, wherein an instantaneous voltage drop is caused by the rush current due to impedance of the AC line, with the result that a so-called flicker occurs. The flicker means a flicker of interior lighting equipment due to the instantaneous voltage drop of the AC line. The flicker uncomfortably affects a feeling of a user. Especially, the high-speed laser beam printer and the electrophotographic copying machine requires a high-power heater, and there must be a large influence by this flicker.

For coping with this problem arising from the flicker, as disclosed in, e.g., Japanese Patent Application Laid-Open No. H6-230702, not the low-frequency ON/OFF control by the TRIAC but the high-frequency switching control is adopted. A Field Effect Transistor (FET) is employed as a device for this switching control, and a LC filter circuit is utilized for an output of the switching circuit in order to restrain copy noises.

The switching device such as the FET switches ON/OFF only the current in one direction at a high frequency, and therefore requires a circuit for full-wave-rectifying an AC line voltage. Namely, an AC sine wave pattern is converted into a full-wave-rectified voltage wave pattern, the full-wave-rectified voltage wave pattern is further subjected to switching by the FET, then the wave pattern thereof is corrected by the LC filter, and the wave-pattern-corrected voltage is supplied to the heater. The FET as the switching device, though ON/OFF-controlled at the high frequency, adjusts a peak value or an average value of the voltage wave pattern applied to the heater. Namely, the FET keeps the voltage supplied to the heater to a predetermined value. Then, when the heater is switched ON/OFF, a duty cycle ratio thereof is so controlled as to gradually increase from a low value. The control of the duty cycle at the ON/OFF time is called slow-up control. Under this slow-up control, the peak value or the average value of the full-wave-rectified voltage applied to the heater when switched ON/OFF rises stepwise, and hence there is no excessive flow of the rush current at the ON/OFF time.

Thus, the rush current can be restrained low by performing the ON/OFF control of the switching device operating at the high frequency, thereby obviating the flicker problem.

The laser beam printer and the electrophotographic copying machine are, however, accompanied with a difficulty other than the flicker in order to control the electric power for the heater. This is a restriction of the maximum electric power.

In Japan, the AC line voltage is nominally 100 V (an effective value) for the general interior wiring, and the maximum current per receptacle is determined to be 15 A. Accordingly, in the 100 V wiring, only the electric power of 1,500 W at the maximum can be supplied. Further, in North America, the AC line voltage is nominally 120 V (the effective value), and the maximum current per receptacle is determined to be 13.2 A. Therefore, in the 120 V wiring, only the electric power of 1,584 W at the maximum can be supplied. In EU, the AC line voltage is nominally 230 V, and the maximum current per receptacle is 10 A. Hence, the electric power up to 2,300 W can be supplied.

On the other hand, in the high-speed laser beam printer and electrophotographic copying machine (capable of printing, e.g., 50 sheets per minute), the electric power needed for the heater is as high as 1,000 W. The heater consumes the electric power as much as 1,000 W of the total electric power of 1,500 W. Consequently, all the control of the apparatus must be done by the remaining electric power of 500 W. Moreover, the heater drive circuit has a drive loss, and therefore the electric power utilizable for other than a heater system becomes much less. Still further, the high-speed electrophotographic copying machine involves the use of a glass tube lamp for scanning an image of an original, and a large amount of electric power is consumed for this glass tube lamp. Furthermore, in the high-speed laser beam printer and electrophotographic copying machine, a sheet feeding device and a sheet discharging device (a stacker and a stapler) as options are utilized often together, and hence it is more difficult to restrain the electric power down to totally 1,500 W or under. As a matter of fact, however, power supply lines of approximately 200 V, though existing in Japan and North America, are not widely utilized. Therefore, the apparatuses operable at 100 V and 120 V gain high popularity.

Another problem is that the electric power consumed by the heater has a large dispersion. The electric power consumed by the glass tube heater such as a halogen heater has a large dispersion (which is normally on the order or ±3.5%) depending on lots. Taking this dispersion into account, the electric power must be restrained down to totally 1,500 W or under in Japan. In a case where a resistance value of the heater is low and the electric power consumed rises, if contrived to meet this specified electric power of 1,500 W, it follows that there occurs a 7% decrease at the maximum in the electric power for consumption on such an occasion that the heater resistance value rises and the electric power consumed by the heater is lowered. For example, assuming a fixing unit requiring 1,000 W in a way that takes the heater-related power dispersion into consideration, it follows that the electric power consumed by the heater comes to 1,070 W at the maximum due to a dispersion of the resistance value of the heater. As a result, there occurs a 70 W reduction in the amount of electric power utilizable for other than the heater.

As described above, under circumstances of the power supply voltages in Japan and North America and due to the dispersion in the electric power for the glass tube heater, the high-speed laser beam printer and electrophotographic copying machine have a difficulty to attain the restriction of the maximum electric power. In fact, in Japan and North America, the high-speed machine capable of printing approximately 80 sheets per minute has no alternative but to utilize the 200V power supply.

Accordingly, the high-speed laser beam printer and electrophotographic copying machine is incapable of further improving the printing speed because of the restriction of the total amount of utilizable electric power.

SUMMARY OF THE INVENTION

It is an object of the present invention to provide a heater drive circuit capable of improving a printing speed of an image forming apparatus to the greatest possible degree under such a condition that a total amount of utilizable electric power is restricted in the image forming apparatus including a fixing heater (a heating heater).

To accomplish the above object, a heater drive circuit according to the present invention comprises current detecting means for detecting a value of a current across an AC power supply line that is supplied from a commercial AC power supply, full-wave rectifying means for full-wave-rectifying an AC voltage on the AC power supply line, switching control means for performing switching control of the full-wave-rectified voltage from the full-wave-rectifying means at a high frequency, filter means for removing a high frequency component contained in a switching output from the switching control means, a heating heater receiving an application of an output from the filter means, and heater control means for ON/OFF-controlling the switching control means on the basis of the current value detected by the current detecting means.

According to the present invention, even if a resistance value of the heating heater has a dispersion, the heating heater can be supplied with the stable electric power, and hence the electric power supplied to the heating heater can be increased to the limit of the standard value of the current of the AC power supply line, whereby the heater drive circuit can be utilized as a high-output heater drive circuit.

Preferably, the current detecting means is constructed of a current transformer interposed in series in the AC power supply line and a rectification circuit connected to an output winding of the current transformer.

Preferably, the switching means includes a switching transistor and a current retaining diode connected to the switching transistor, and changes an ON/OFF duty of the switching transistor.

Preferably, the heater control means gradually increases the ON/OFF duty when starting the drive of the heater as set ON from OFF, and controls the ON/OFF duty so that the current value detected by the current detecting means is held to a predetermined value at a point of time when predetermined or longer time elapses since the start of the operation.

Another heater drive circuit according to the present invention comprises current detecting means for detecting a value of a current across an AC power supply line that is supplied from a commercial AC power supply, full-wave rectifying means for full-wave-rectifying an AC voltage on the AC power supply line, switching control means for performing switching control of the full-wave-rectified voltage from the full-wave-rectifying means at a high frequency, filter means for removing a high frequency component contained in a switching output from the switching control means, a heating heater receiving an application of an output from the filter means, voltage detecting means for detecting a voltage applied to the heating heater, and heater control means for ON/OFF-controlling the switching control means on the basis of the current value detected by the current detecting means and the voltage value detected by the voltage detecting means.

Preferably, the voltage detecting means detects any one of an average value and a peak value of the voltage applied to the heating heater.

Preferably, the current detecting means is constructed of a current transformer interposed in series in the AC power supply line and a rectification circuit connected to an output winding of the current transformer.

Preferably, the switching control means includes a switching transistor and a current retaining diode connected to the switching transistor, and changes an ON/OFF duty of the switching transistor.

Preferably, the heater control means gradually increases the ON/OFF duty when starting the drive of the heater as set ON from OFF, and controls the ON/OFF duty so that the current value detected by the current detecting means is held to a predetermined value at a point of time when predetermined or longer time elapses since the start of the operation.

Preferably, the heater drive circuit further comprises storage means for storing the voltage value detected by the voltage detecting means when controlling the ON/OFF duty of the switching control means so that the current value detected by the current detecting means comes to a predetermined value in a state where the voltage value on the AC power supply line is fixed to a predetermined value, wherein the switching control means, when a predetermined condition is met, controls the ON/OFF duty so that the voltage value detected by the voltage detecting means is equalized to the voltage value stored on the storage means or to a value corresponding to the voltage value.

With this contrivance, even when the voltage of the AC power supply line fluctuates in addition to the dispersion in the resistance value of the heating heater, the electric power supplied to the heating heater can be stabilized. It is therefore possible to increase the electric power supplied to the heating heater to the limit of the standard value of the current of the AC power supply line, whereby the heater drive circuit can be utilized as a high-output heater drive circuit.

Preferably, the predetermined condition is a condition that the heater drive circuit be utilized by a general user.

DESCRIPTION OF THE PREFERRED EMBODIMENTS

Embodiments of the present invention will hereinafter be described in detail with reference to the accompanying drawings.

Figure 1:
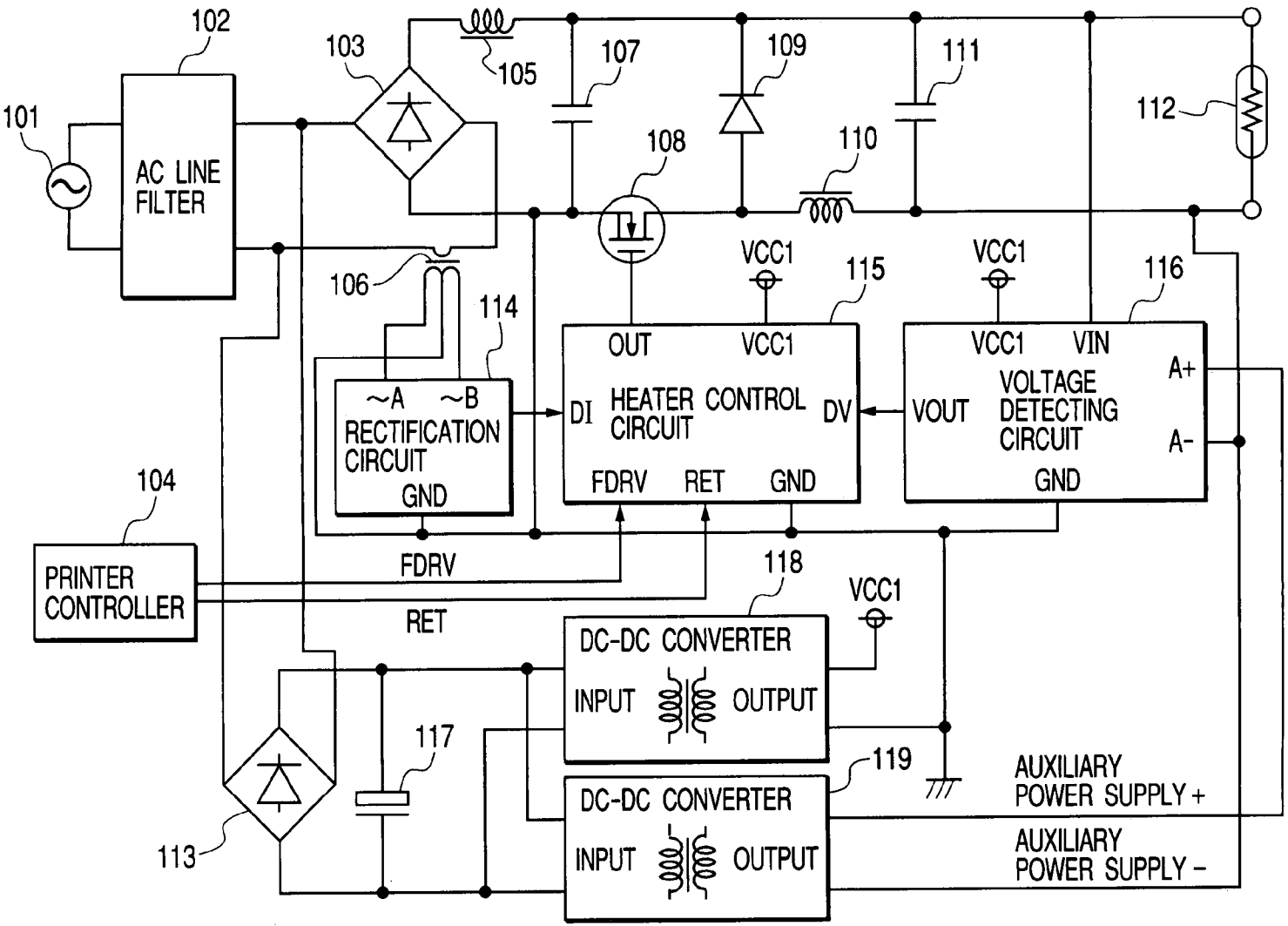
FIG. 1 is an electric circuit diagram showing a configuration of a heater drive circuit in a first embodiment of the present invention.

FIG. 1 is an electric circuit diagram showing a configuration of a heater drive circuit in a first embodiment of the present invention.

In FIG. 1, a rectification circuit 114 converts an AC voltage into a DC voltage, a heater control circuit 115 controls switching of a heater 112, and a voltage detecting circuit 116 detects a peak value or an average value of full-wave rectification voltage wave patterns applied to the heater 112.

Figure 2:
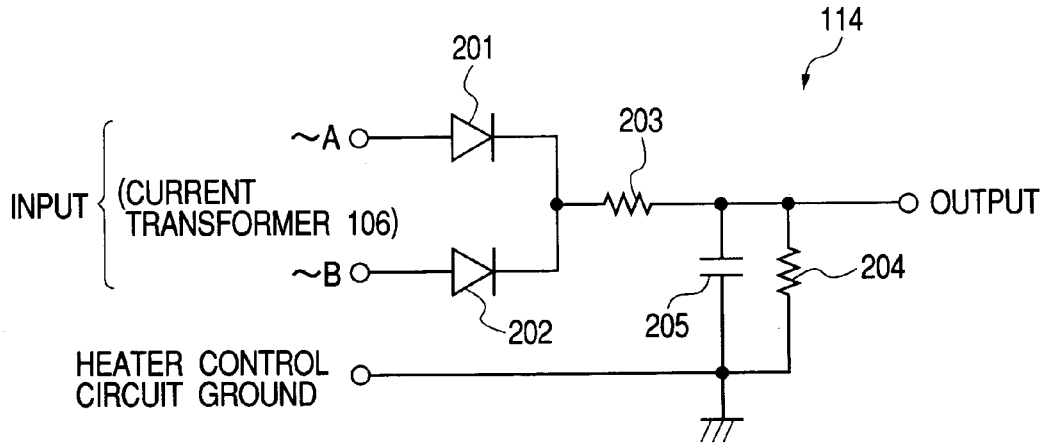
FIG. 2 is a diagram showing detailed circuitry of a rectification circuit in FIG. 1.
Figure 3:
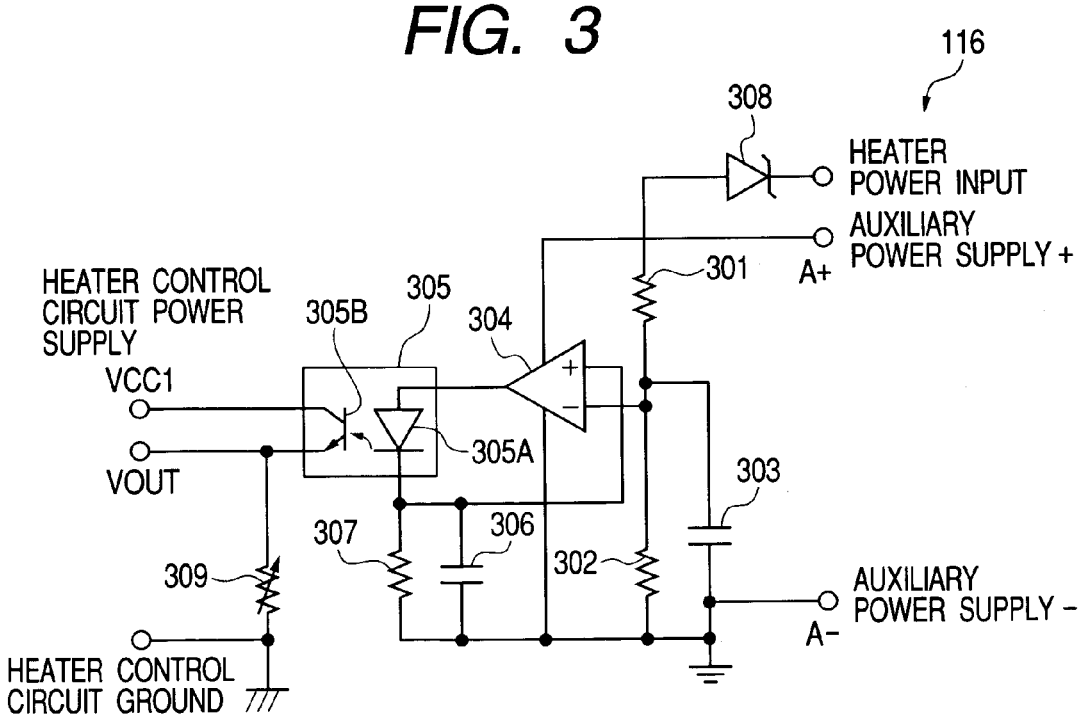
FIG. 3 is a diagram showing detailed circuitry of a voltage detecting circuit in FIG. 1.
Figure 4:
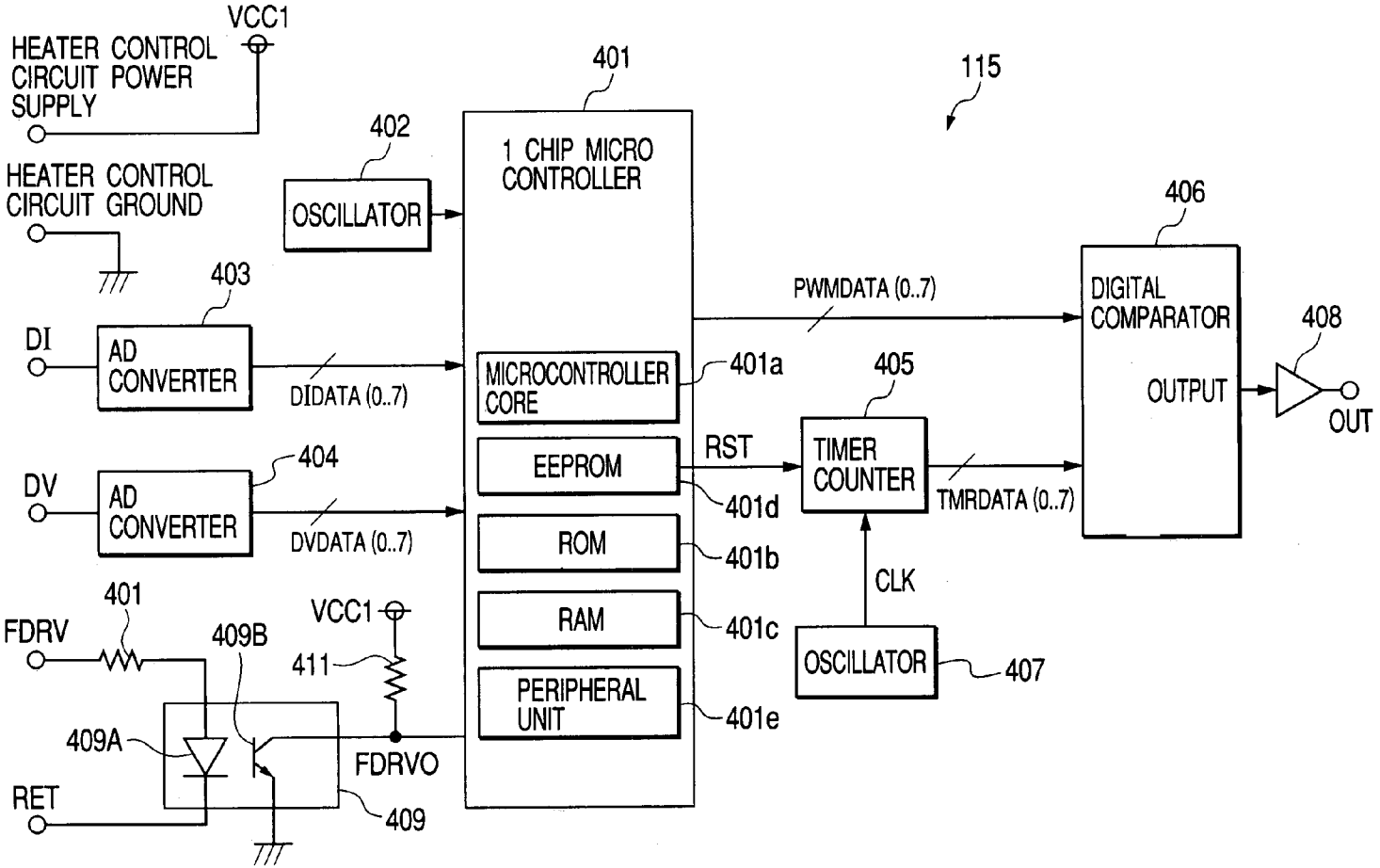
FIG. 4 is a diagram showing detailed circuitry of a heater control circuit in FIG. 1.

FIG. 2 is a diagram showing detailed circuitry of the rectification circuit 114. FIG. 3 is a diagram showing detailed circuitry of the voltage detecting circuit 116. FIG. 4 is a diagram showing detailed circuitry of the heater control circuit 115.

Note that DC—DC converters 118 and 119 are shown in the block diagram, however, the detailed circuitry thereof is not illustrated. This is because these DC—DC converters 118 and 119 are normally often used. The DC—DC converters 118 and 119 control output voltages to desired voltage values, respectively. Further, in each of interiors of the DC—DC converters 118 and 119, a primary-side input and a secondary-side input are electrically separated. Namely, a transmission of electric power from the primary side to the secondary side involves the use of a switching transformer. Moreover, a signal is transmitted by a photo coupler to the primary side from the secondary side in order to stabilize the voltage on the secondary side.

Further, a printer controller 104 is shown in the block diagram but does not characterizes the present invention, and hence its detailed circuitry is not illustrated.

Referring to FIG. 1, an AC power supply 101 is commercial electric power supplied from outside and is, if in Japan, AC 100V.

An AC line filter 102 serves to prevent switching noises caused by the heater drive circuit in the first embodiment from being transferred to an outside AC line. The AC line filter 102 is constructed of a common mode choke and a cross line condenser as utilized by a normal electric appliance. These components are not circuits characteristic of the present invention, and therefore their detailed circuitry is not illustrated.

An AC voltage outputted by the AC line filter 102 is inputted to a diode bridge 103. The diode bridge 103 serves to effect full-wave rectification of an AC voltage wave pattern. The diode bridge 103 is well known as a device for generating a DC (direct current) voltage from an AC voltage, and is normally constructed of four pieces of diodes. The diode bridge 103 is the well-known device, and hence its detailed explanation is omitted.

The current transformer 106 is connected in series to the diode bridge 103. The biggest different point of the current transformer 106 from a normal voltage conversion transformer is that an input impedance as viewed from the primary side is extremely small. For obtaining this characteristic, the number of turns of the primary-side windings is minimized (which is normally one turn), and the primary side and the secondary side are set in loose coupling. As the primary-side input impedance of the current transformer 106 is extremely small, a large proportion of the AC voltage outputted by the AC line filter 102 is applied to the diode bridge 103, and almost none of the voltage is applied to an input terminal of the current transformer 106.

An output-side winding of the current transformer 106 is provided with three pieces of terminals. A tap terminal in the middle thereof is connected to the ground of the heater control circuit 115, and the terminals at both side ends thereof are inputted to the rectification circuit 114. Since the number of turns of the secondary-side windings of the current transformer 106 is taken extremely large, some amount of AC voltage is induced on the secondary side of the current transformer 106, though only a slight voltage is applied to the input terminal of the current transformer 106. The voltage induced on the secondary side is inputted a ~A terminal and a ~B terminal of the rectification circuit 114. The rectification circuit 114 performs the full-wave rectification of the AC voltage wave pattern inputted, and converts the AC voltage into a DC voltage by use of a filter circuit thereof.

As shown in FIG. 2, the rectification circuit 114 is constructed of diodes 201, 202 for effecting the full-wave rectification of the inputted AC voltage wave pattern, and of the filter circuit consisting of resistances 203, 204 and a capacitor 205.

Thus, the current transformer 106 and the rectification circuit 114 cooperate to be capable of detecting the AC current of the AC power supply.

Referring back to FIG. 1, a detection output from the rectification circuit 114 is inputted to a DI terminal of the heater control circuit 115.

Figure 5:
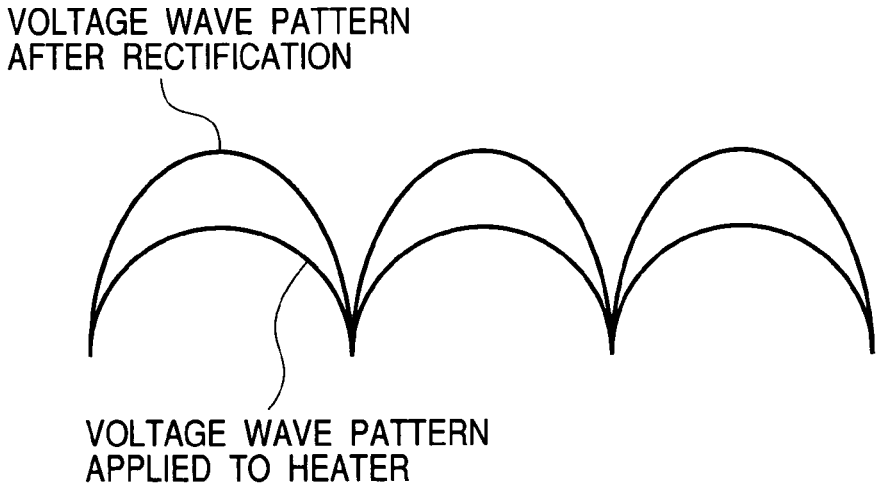
FIG. 5 is a diagram showing a voltage wave pattern after being rectified and a heater drive voltage wave pattern at a normal time.

Now, the voltage subjected to the full-wave rectification in the diode bridge 103 undergoes a voltage conversion by a switching converter. This switching converter is constructed of inductors 105, 110, film capacitors 107, 111, a FET 108 and a diode 109. This switching converter is a so-called down-converter from which to output such a wave pattern that the full-wave-rectified voltage wave pattern is reduced as shown in FIG. 5, wherein the peak value (or the average value) of the full-wave-rectified voltage pattern is decreased. Herein, the FET 108 functions as a switching device, and the diode 109 is a diode for a flywheel. The inductor 110 and the film capacitor 111 configure a filter circuit and are devices indispensable for the down converter. The inductor 105 and the film capacitor 107 function as a filter of an input part of the down converter. This LC filter hinders a high-frequency switching current from flowing to the diode bridge 103 and to the primary winding of the current transformer 106. An on-time ratio at a switching cycle of this down converter is called an ON duty ratio. The peak value (or the average value) of the full-wave rectification wave pattern applied to the heater 112, increases or decreases in proportion to this ON duty ration.

The heater control circuit 115 controls the ON duty ratio on the basis of the signal received from the rectification circuit 114 and the signal received from the voltage detecting circuit 116, thereby performing the switching control of the FET 108. The voltage detecting circuit 116 outputs, to the heater control circuit 115, a voltage proportional to the peak value (or the average value) of the voltage applied to the heater 112. Accordingly, the heater control circuit 115 executes the switching control in a way that detects the input AC current and the voltage applied to the heater 112.

Circuits for supplying the DC power are, as a matter of course, required for operating the heater control circuit 115 and the voltage detecting circuit 116. The circuits for supplying the DC power are the aforementioned DC—DC converters 118, 119. The AC voltage wave pattern after the AC line filter 102 is full-wave-rectified by the diode bridge 113. Then, an electric field capacitor 117 converts this AC voltage into a DC voltage containing somewhat a ripple. The DC voltage containing the ripple is inputted to the DC—DC converters 118, 119. The DC converters 118, 119 output an object DC voltage containing the small amount of ripple. The DC voltage from the DC—DC converter 118 is used mainly in the heater control circuit 115, while the DC voltage from the DC—DC converter 119 is used as an auxiliary power supply output in the voltage detecting circuit 116.

Thus, a reason why the power supply circuit is separated into the DC—DC converters 118, 119 is that a reference ground potential of the heater control circuit 115 is different from that of the voltage detecting circuit 116. Due to the difference reference ground potentials, as described above, the two pieces of DC—DC converters separated by the transformer are utilized.

Next, an operation of the voltage detecting circuit 116 will be explained with reference to FIG. 3.

Referring to FIG. 3, the power for operating the voltage detecting circuit 116 is supplied from an auxiliary power supply terminal + and an auxiliary power supply terminal –, and these terminals are connected to the output of the DC—DC converter 119 shown in FIG. 1. The auxiliary power is inputted to a power supply terminal of an operational amplifier (OP amp) 304.

In the voltage detecting circuit 116, an input detecting part and a voltage output part are electrically separated. A photo coupler 305 electrically separates the input detecting part and the voltage output part. An input-side circuit part (the input detecting part) of the voltage detecting circuit 116 is constructed of a Zener diode 308, resistances 301, 302, 307, capacitors 303, 306, an OP amp 304, a photo diode 305 (an input portion of the photo coupler 305), and a photo transistor 309B (an output portion of the photo coupler 305). An input-side voltage detecting circuit part consists of elements such as the resistances 301, 302, the capacitor 303 and the Zener diode 308.

When a voltage equal to or higher than a breakdown voltage of the Zener diode 308 is inputted, the current flows to the resistances 301, 302, and a terminal-to-terminal voltage of the resistance 302 is inputted to the OP amp 304. The capacitor 303 is a capacitor for averaging (extracting a low frequency component) the detection voltage. The OP amp 304 functions so that a voltage equal to the terminal-to-terminal voltage of the resistance 302 is applied to between the terminals of the resistance 307. Hence, the current flowing to a photo diode 305A becomes proportional to the terminal-to-terminal voltage of the resistance 302.

Note that the capacitor 306 is provided for stabilizing the current flowing to the photo diode 305A.

When the photo diode 305A receives the inflow of the current and emits the light, a current proportional to the current flowing to the photo diode 305A flows to a photo transistor 305B on the output side. The current flowing to the photo transistor 305B flows to a variable resistance 309, and as a result a terminal-to-terminal voltage of the variable resistance 309 is outputted as a voltage VOUT.

Note that a collector terminal of the photo transistor 305B is connected to a power supply terminal VCC1 of the heater control circuit 115.

A contrivance that the resistance 309 is the variable resistance aims at correcting dispersion in the current of the photo diode 305B. Generally, a current transfer efficiency between the primary side and the secondary side in a photo coupler 305 has approximately a 2-fold dispersion depending on between lots, and therefore the dispersion in the current transfer efficiency is corrected by adjusting a resistance value of the variable resistance 309.

Thus, the voltage proportional to the terminal-to-terminal voltage of the resistance 302 is outputted as the voltage VOUT.

Figure 6:
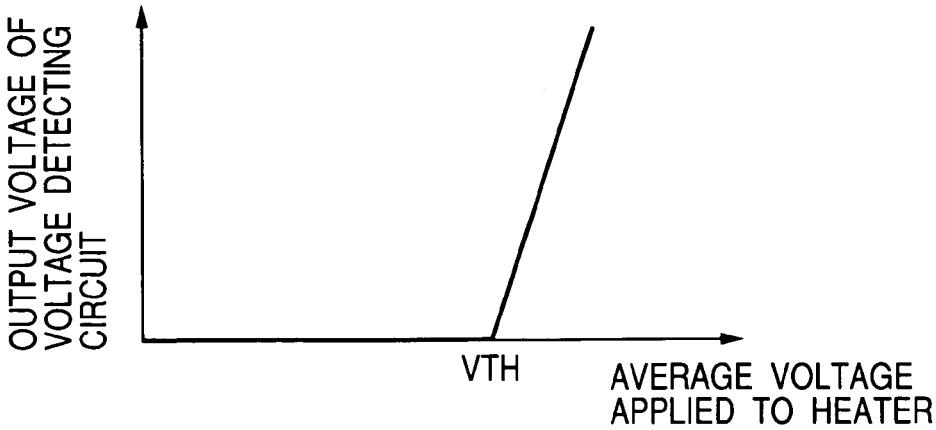
FIG. 6 is a graph showing one example of input/output voltage transfer characteristics of the voltage detecting circuit in FIG. 3.

FIG. 6 is a graph showing one example of input/output voltage transfer characteristics of the voltage detecting circuit 116. In FIG. 6, the axis of abscissas represents an average value of the voltage applied to the heater 112, while the axis of ordinates represents an output voltage of the voltage detecting circuit 116. Herein, a voltage VTH is a voltage value determined from the breakdown voltage of the Zener diode 308.

Thus, a value proportional to the average value (or the peak value) of the voltage applied to the heater 112, can be detected as the voltage VOUT.

It is to be noted that the reason for using the Zener diode 308 lies in an intention that the control be conducted in the vicinity of a target value of the voltage applied to the heater 112.

Next, an operation of the heater control circuit 115 will be explained referring to FIG. 4.

A basic function of the heater control circuit 115 is to generate a pulse Width Modulation (PWM) for driving the FET 108 from pieces of information (serving as information proportional to the AC current and to the average voltage applied to the heater) received from the rectification circuit 114 and from the voltage detecting circuit 116.

Referring to FIG. 4, a 1-chip micro-controller (which will hereinafter be abbreviated to "MC") 401 serves as a core of the heater control circuit 115. An interior of the MC 401 is provided with a MC core 401*a*, a ROM 401*b*, a RAM 401*c*, an EEPROM (Electrically Erasable Programmable ROM) 401*d*, a peripheral unit 401*e* and so on. The MC 401 operates in synchronization with a main clock supplied from an oscillator 402.

An output voltage from the rectification circuit 114 is inputted to the DI terminal of the heater control circuit 115. The voltage inputted to the DI terminal is inputted to an AD converter 403. The AD converter 403 effectuates an AD (Analog-to-Digital) conversion of the inputted analog voltage into digital data (which have herein an 8-bit width), and input the digital data as data DIDATA (0 . . . 7) to the MC 401. Herein, a description of (0 . . . 7) represents data having the 8-bit bus width.

The output voltage from the voltage detecting circuit 116 is inputted to a DV terminal of the heater control circuit 115. A voltage of this DV terminal is inputted to an AD converter 404. The AD converter 404 similarly performs the AD conversion, and the MC 401 is supplied with digital data DVDATA (0 . . . 7).

Thus, the MC 401 detects an AC input current (corresponding to the current flowing to the heater) through the data DIDATA (0 . . . 7), and further detects an average value of the voltage applied to the heater 112 through the data DVDATA (0 . . . 7).

A timer counters 405 counts clocks supplied from the oscillator 407, and outputs a count value as 8-bit data TMRDATA (0 . . . 7) to a digital comparator 406. The timer counter 405 is defined as a so-called free-run timer, and is reset to OH at a next input clock when a timer count value reaches a maximum value (FFH). Therefore, the count value of the timer counter 405 changes in a sawtooth wave pattern from OH to FFH at a predetermined cycle.

Note that the timer counter 405 has an initialization terminal, whereby the timer counter 405 is initialized when a RST signal outputted from the MC 401 becomes "TRUE" (e.g., HIGH LEVEL), and the data TMRDATA (0 . . . 7) is reset to OH.

The digital comparator 406 receives an input of the digital data PWMDATA (0 . . . 7) outputted from the MC 401 and an input of the digital data TMRDATA (0 . . . 7) outputted from the timer counter 405, and compares these two pieces of digital data. Then, when a value of the data TMRDATA (0 . . . 7) is larger than a value of the PWMDATA (0 . . . 7), the comparator 406 outputs HIGH LEVEL.

Thus, the data PWMDATA (0 . . . 7) is converted by the comparator 406 into a PWM pulse having a predetermined cycle, and the PWM pulse is inputted to a driver 408. Further, an output of the driver 408 is inputted as an output OUT of the heater control circuit 115 to a gate of the FET 108.

Thus, the PWM pulse is applied to the FET 108.

Resistances 410, 411 and a photo coupler 409 form a circuit for receiving ON/OFF commands from an exterior of the heater control circuit 115. The exterior of the heater control circuit 115 implies a printer controller 104 in FIG. 1. The photo coupler 409 is provided for attaining an electrical separation in order to receive the commands from the exterior. The ground of the heater control circuit 115 is connected to a source terminal of the FET 108. Namely, even the ground of the heater control circuit 115 has a large potential difference as compared with a box body of the control apparatus, and hence it is required that the printer controller 104 be electrically separated from the heater control circuit 115.

When the heater control circuit allows the current to flow toward an RET terminal from an FDRV terminal, the current is transferred via the photo coupler 409 and inputted as a FDRVO signal to the MC 401. The MC 401, upon receiving "TRUE" of the FDRVO signal, starts the heater control. Control processing thereof will hereinafter be explained.

Figure 7:
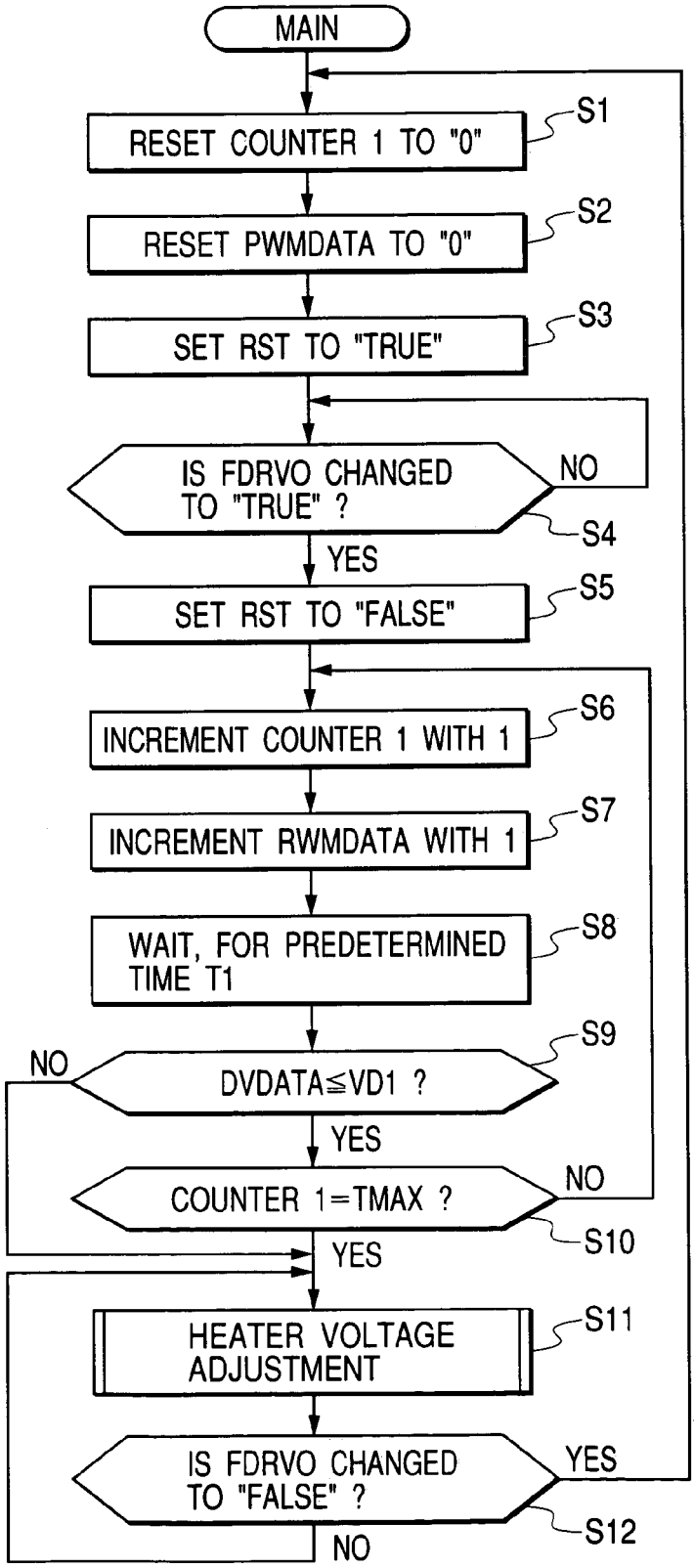
FIG. 7 is a flowchart showing procedures of a main routine executed by a micro controller in FIG. 4.
Figure 8:
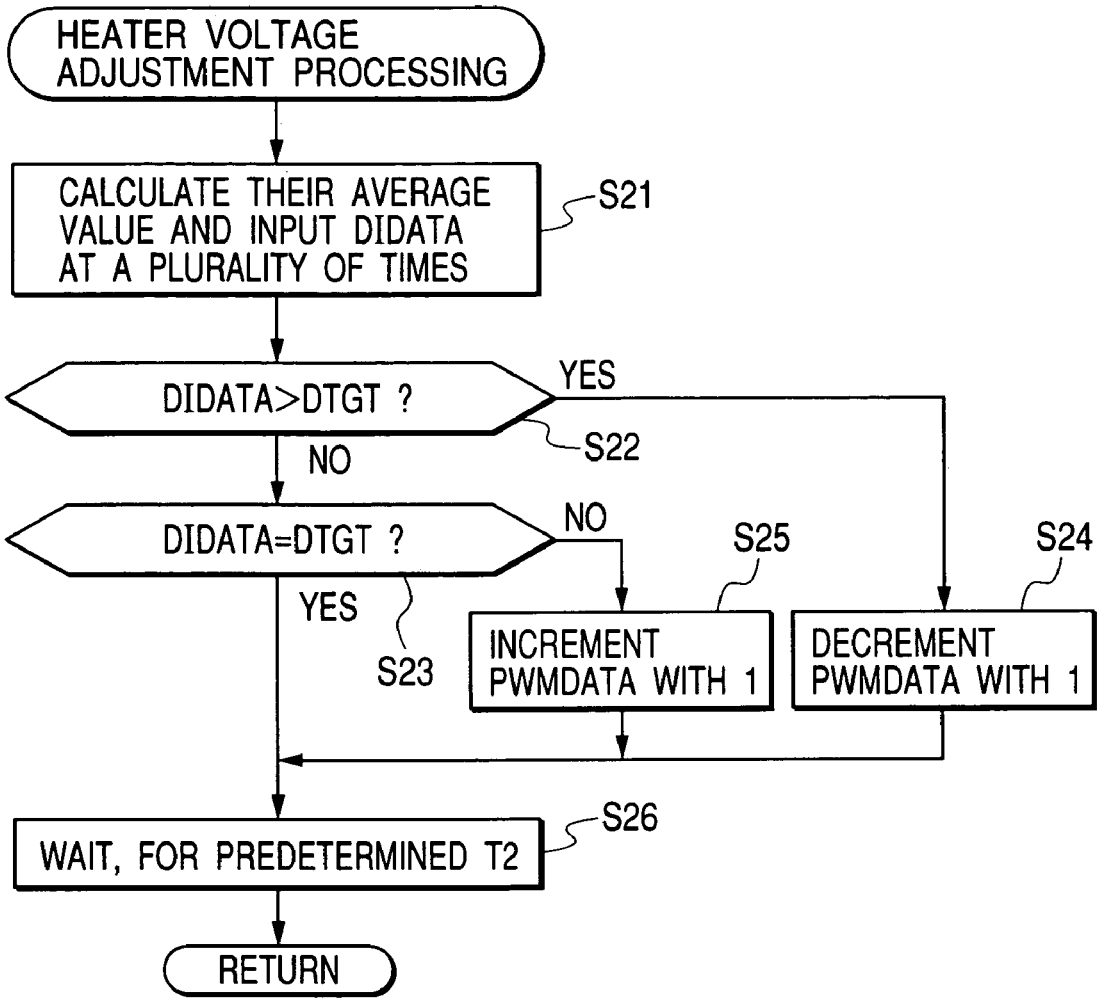
FIG. 8 is a flowchart showing in-depth procedures of a heater voltage adjustment processing subroutine in step S11 in FIG. 7.

FIG. 7 is a flowchart showing procedures of a main routine executed by the MC 401. FIG. 8 is a flowchart showing in-depth procedures of a heater voltage adjustment processing subroutine in step S11 of the main routine.

When the power supply is switched ON, the main routine in FIG. 7 is started up, wherein the MC 401 at first executes initialization processing in steps S1–S3. In step S1, a counter 1 stored on the memory (RAM 401*c*) within the MC 401 is reset to "0". In step S2, the data PWMDATA (0 . . . 7), which should be outputted to the digital comparator 406, is reset to "OH". Owing to this resetting, the value of the data PWMDATA (0 . . . 7) inputted to the comparator 406 becomes "OH". In step S3, the MC 401 sets the RST signal to "TRUE" (e.g., HIGH LEVEL) and initializes the timer counter 405. The data TMRDATA (0 . . . 7) outputted from the timer counter 405 is thereby reset to "OH", and the output of the comparator 406 comes to "0".

Thus, in the initial state, the FET 108 is set in an OFF-state.

Next, in step S4, the MC 401 monitors the FDRVO signal and continues to wait in step S4 till the FDRVO signal becomes "TRUE" (e.g., LOW LEVEL). When the printer controller 104 gives an instruction of the operation of the heater, the current flows to the FDRV terminal, and the FDRVO signal comes to the "TRUE" state. When the MC 401 receives the FDRVO signal of "TRUE", the processing proceeds to step S5, wherein the RST signal is set in a "FALSE" state. From this moment onwards, the timer counter 405 starts counting in synchronization with the clock outputted by the oscillator 407.

Then, the MC 401 increments the counter 1 by 1 (step S6), and similarly increments the value of the data PWMDATA (0 . . . 7) by 1 (step S7). At this time, the value of the data PWMDATA increases by 1, and the data value thereof is inputted to the digital comparator 406.

Next, the MC 401, after waiting for predetermined time T1 (step S8), moves to next step S9. In step S9, the MC 401 judges whether or not the value of the data DVDATA (O . . . 7) is equal to or smaller that a predetermined value VD1. If DVDATA (0 . . . 7)≦VD1, the MC 401 moves to step S10. Whereas if DVDATA (0 . . . 7)>VD1, the MC 401 moves to step S11.

In step S10, the MC 401 judges whether or not the value of the counter 1 reaches a value TMAX or not. If the counter 1≠TMAX, the MC 401 returns to step S6. Whereas if the counter 1=TMAX, the MC 401 moves to step S11.

The processing in steps S6 to S10 implies that if the value of the data DVDATA (0 . . . 7) is equal to or smaller than the value VD1, and for a period during which the value of the counter 1 does not reach the value TMAX, the value of the data PWMDATA (0 . . . 7) is to be incremented. With this increment, the ON duty ratio of the PWM pulse inputted to the FET 108 increases step by step from 0, thus increasing the ON duty ratio of the FET 108 till the voltage applied to the heater 112 reaches the predetermined value (till the value of the data DVDATA (0 . . . 7) comes to the value VD1). A series of processing described above corresponds to a slow-up sequence of the heater 112. If the slow-up sequence of the heater 112 is carried out, the peak value of the full-wave rectification wave pattern applied to the heater 112 gradually rises.

Figure 9:
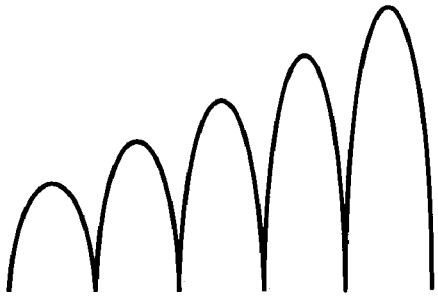
FIG. 9 is a diagram showing one example of a voltage wave pattern applied to the heater when in a heater slow-up sequence.

FIG. 9 conceptually illustrates this state. In FIG. 9, the peak value of the full-wave rectification wave pattern abruptly rises. In fact, however, this peak value is extremely slowly raised. The slow rise thereof may involve elongating the waiting time in step S8. What has been described so far is the slow-up sequence when switching the heater ON.

Step S11 is an execution of applied voltage adjustment processing of the heater 112 after the slow-up. As described above, the heater voltage adjustment processing in step S11 involves performing the control shown in FIG. 8.

Referring to FIG. 8, the MC 401, to begin with, reads the data DIDATA (0 . . . 7) a plural number of times and obtains an average value thereof. This average value is set afresh as data DIDATA (0 . . . 7).

Then, the MC 401 compares the value of the data DIDATA (0 . . . 7) with a preset value DTGT, and thus examines a relationship between their magnitudes (steps S22, S23). If DIDATA (0 . . . 7)>DTGT, the MC 401 moves to step S24, wherein the value of the data PWMDATA (0 . . . 7) is decremented by 1. If DIDATA (0 . . . 15)<DTGT, the MC 401 moves to step S25, wherein the value of the data PWMDATA (0 . . . 7) is incremented by 1. Further, if DIDATA (0 . . . 15)=DTGT, none of the data PWMDATA (0 . . . 7) is changed.

Then, the MC 401 moves to processing in step S26 and, after waiting just for predetermined time T2, terminates the present heater voltage adjustment processing.

Figure 12:
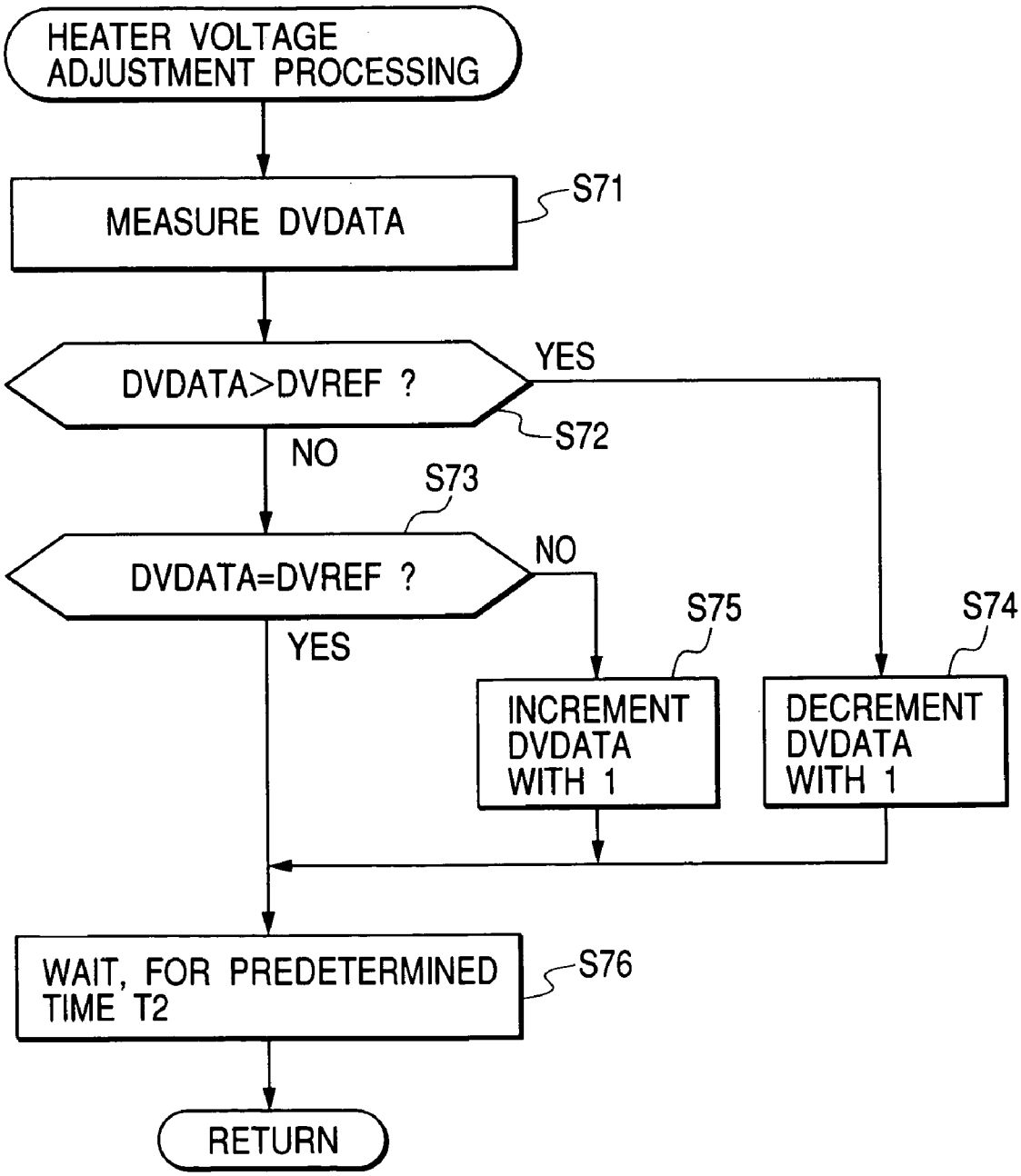
FIG. 12 is a flowchart showing in-depth procedures of a heater voltage adjustment processing subroutine in step S39 in FIG. 10.

Subsequently, returning to step S12 in FIG. 12, the MC 401 checks whether the FDRVO signal becomes "FALSE" or not. As far as the FDRVO signal is "TRUE", the MC 401 repeatedly executes the heater voltage adjustment processing in step S11 many times. While on the other hand, when the FDRVO signal becomes "FALSE", the MC 401 moves back to first step S1, wherein the FET 108 is switched OFF.

Thus, the value of the data DIDATA (0 . . . 7) is substantially equalized to the value DTGT. The value of the data DIDATA (0 . . . 7) is stabilized to the predetermined value, which means that the electric power supplied to the heater 12 is stabilized to the predetermined value. The reason why so is that unless the AC power supply voltage 101 changes, the voltage inputted to the diode bridge 103 is kept to a desired value, and the current flowing to the diode bridge 103 is likewise kept to the predetermined value. Namely, supposing that the resistance value of the heater 112 decreases due to the dispersion in the lots, the value of the data DIDATA (0 . . . 7) is to be maintained to a fixed value, the voltage applied to the heater 112 somewhat decreases, and nevertheless the value of the current flowing to the diode bridge 103 remains unchanged. Conversely, if the resistance value of the heater 112 increases, the voltage applied to the heater 112 rises. Accordingly, even if the resistance value of the heater 112 has dispersion due to the lots, the electric power supplied to the heater 112 can be stabilized. Further, as a matter of course, as the slow-up sequence is conducted, the rush current at the ON-time of the heater 112 can be restrained low. Moreover, in the first embodiment, the AC current is converted into the voltage level by use of the current transformer for detecting the current, and hence the AC current can be detected at a high accuracy with a less loss of the detection.

(Second Embodiment)

According to the first embodiment, even when the resistance value of the heater 112 is dispersed to some extent, the electric power supplied to the heater 112 can be stabilized to the predetermined value. If the voltage of the AC power supply to be inputted changes, however, the electric power supplied to the heater 112 changes as the voltage changes.

A contrivance in a second embodiment is to improve this point. A difference of the second embodiment from the first embodiment is only the control processing executed by the micro-controller, and therefore the hardware components in the first embodiment will be employed as they are.

Figure 10:
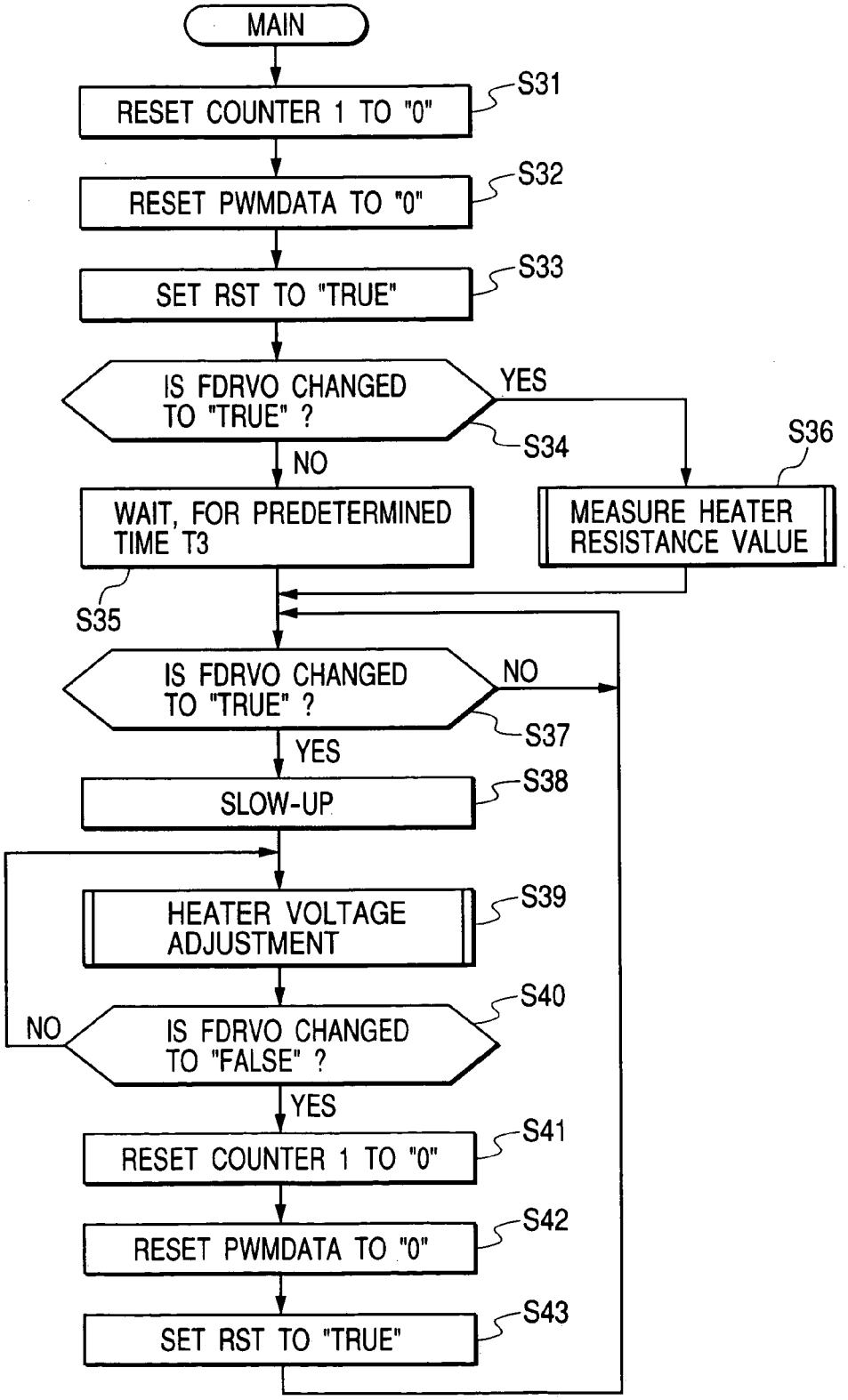
FIG. 10 is a flowchart showing procedures of a main routine executed by the micro controller for a heater control circuit contained in the heater drive circuit in the first embodiment of the present invention.
Figure 11:
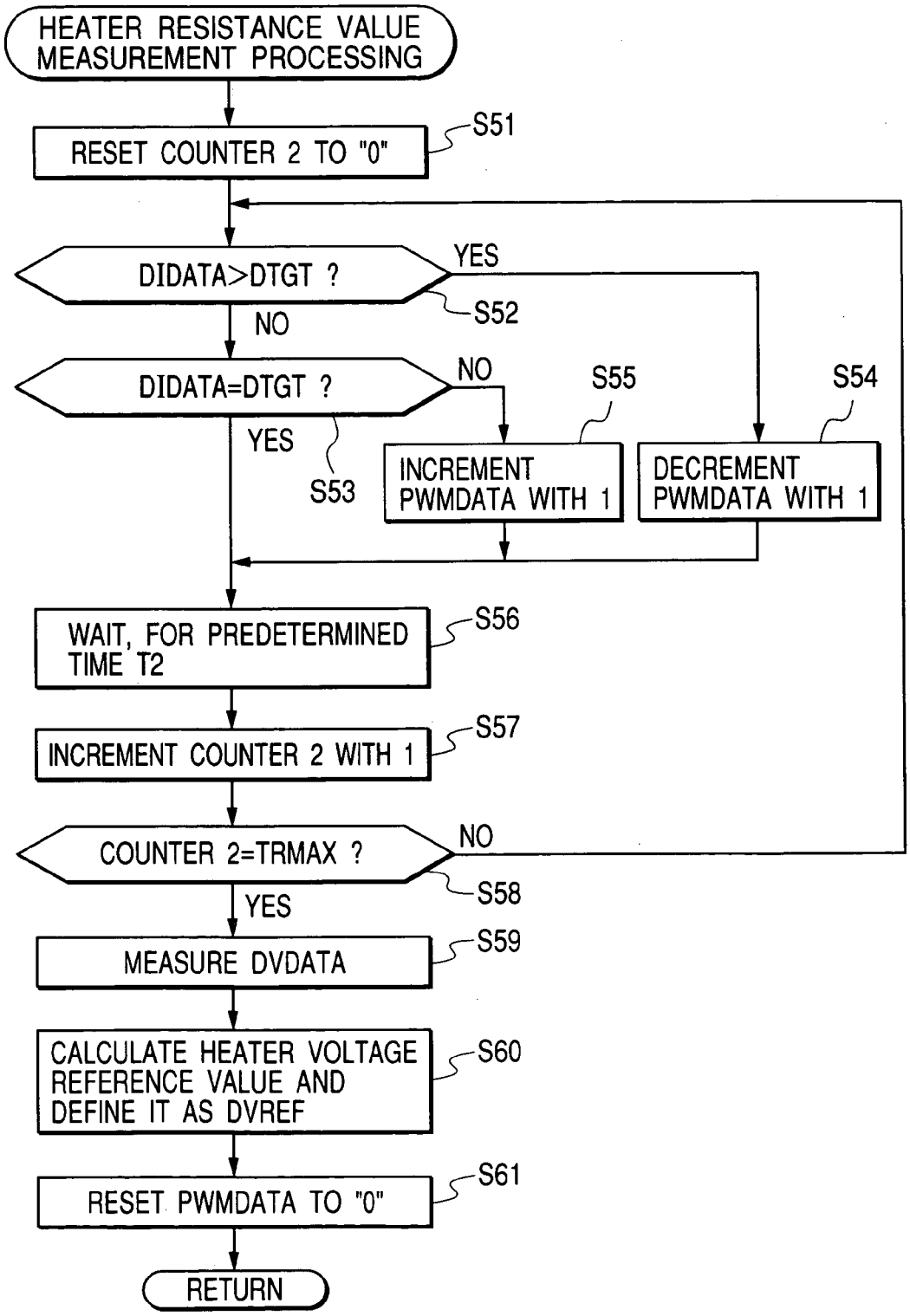
FIG. 11 is a flowchart showing detailed procedures of a heater resistance value measurement processing subroutine in step S36 in FIG. 10.

FIG. 10 is a flowchart showing procedures of a main routine executed by the MC 401 in the second embodiment. FIG. 11 is a flowchart showing detailed procedures of a heater resistance value measurement processing subroutine in step S36 of the main routine. FIG. 12 is a flowchart showing in-depth procedures of a heater voltage adjustment processing subroutine in step S39 of the main routine.

The heater drive circuit in the second embodiment is characterized by newly providing resistance value measurement processing of the heater 112. The resistance value measurement processing is normally executed when shipping, from a factory, the heater drive circuit or a control apparatus such as a electrophotographic printer including the heater drive circuit. The resistance value measurement processing is not executed in a normal use by the user.

As shown in FIG. 10, it is judged in step S34 whether the resistance value measurement processing is executed or not. Namely, after switching the power supply ON, the resistance value measurement processing is carried out by judging a level of the FDRVO signal in step S34 immediately after the power supply initialization processing in steps S31 to S33. The processing in steps S31–S33 just after the power-ON is the same as the processing in steps S1–S3 in the first embodiment discussed above. In the case of judging that the FDRVO signal is "TRUE" just after the power-ON, the MC 401 moves to step S36, wherein the heater resistance value measurement processing shown in FIG. 11 is executed. In the case of judging that the FDRVO signal is "FALSE" just after the power-ON, the MC 401 waits for predetermined time T3 in step S35 while executing nothing. Then, the MC 401 moves to the heater drive processing in the main routine. In step S37, the MC 401 again monitors the FDRVO signal and waits till the FDRVO signal becomes "TRUE". Even in the case of executing the heater resistance value measurement processing in step S36, the MC 401 moves to step S37 after finishing the heater resistance value measurement processing, and waits till the FDRVO signal becomes "TRUE".

In the heater resistance value measurement processing, to start with, in step S51 in FIG. 11, the MC 401 resets an internal counter 2 to "0", subsequently reads a value of the data DIDATA (0 . . . 7), and judges whether or not the value of the data DIDATA (0 . . . 7) is equal to or larger or smaller than the predetermined value DTGT (steps S52, S53). If DIDATA (0 . . . 7)=DTGT, the MC 401 moves to step S56 in a way that executes nothing. If DIDATA (0 . . . 7)>DTGT, the MC 401 moves to step S54 and decrements the value of the data PWMDATA (0 . . . 7) by 1. If DIDATA (0 . . . 7)<DTGT, the MC 401 moves to step S55, wherein the MC 401 increments the value of the data PWMDATA (0 . . . 7) by 1. Then, the MC 401 moves to step S56 and waits for only the predetermined time T2. Subsequently, the MC 401 moves to step S57, wherein the MC 401 increments a value of the counter 2 by 1, and moves further to S58. In step S58, the MC 401 judges whether the value of the counter 2 becomes equal to the predetermined value TMAX. If the counter 2≠TMAX, the MC 401 moves back to S52. When the processing in these steps S52 to S58 is repeatedly executed, feedback processing that follows is to be executed. Namely, the initial value of the data PWMDATA (0 . . . 7) is "0", and hence the current does not flow to the heater 112 for the first time, and the value of the data DIDATA (0 . . . 7) is, as a matter of course, smaller than the value DTGT. Then, the value of the PWMDATA (0 . . . 7) is incremented till the value of the data DIDATA (0 . . . 7) reaches the value DTGT. Thereafter, the data PWMDATA (0 . . . 7) is incremented and decremented so that the value of the data DIDATA (0 . . . 7) gets approximate to the value DTGT. Then, when the value of the counter 2 reaches the predetermined value TMAX (which corresponds to the wait for the predetermined time), the increment/decrement process is stopped. The value of the data DIDATA (0 . . . 7) is thereby converged at a value substantially equal to the value DTGT. If the voltage inputted to the heater drive circuit, i.e., the voltage of the AC power supply 101 is fixed to a predetermined value (in this case, it is desirable that the voltage be set to a standard value of the commercial AC power supply), the AC current likewise converges at the predetermined value, and it is therefore concluded that the electric power inputted to the heater drive circuit is fixed to the predetermined value. On the other hand, a loss of the electric power due to the switching loss of the FET 108 is not so dispersed, and consequently it follows that the electric power supplied to the heater in the heater resistance value measurement processing converges at a predetermined value. Accordingly, as far as the voltage of the AC power supply 101 is fixed to the predetermined value, even if the resistance value of the heater 112 has the dispersion, it follows that the electric power supplied to the heater 112 converges at the fixed value.

Then, the MC 401 moves to step S59 and measures a value of the data DVDATA (0 . . . 7) at that time. The value of the data DVDATA (0 . . . 7) is a value proportional to the peak value of the voltage applied in fact to the heater 112, and hence a heater resistance value can be presumed from the thus measured data DVDATA (0 . . . 7) in the following formula.

$$\text{Heater resistance value}=K\times\text{DVDATA}(0\ldots15)^2$$

where K is the fixed value.

Then, the MC 401 moves to step S60, and determines a heater voltage reference value DVREF for determining the electric power supplied to the heater 112. The value DVREF may be equalized to the value of the data DVDATA (0 . . . 15) obtained when measured. Further, the value DVREF is stored in the EEPROM 401*d* provided within the MC 401. Namely, even if the power supply is switched OFF, the value DVREF is kept unerasable as it is stored on the nonvolatile memory.

Then, the MC 401 terminates the heater resistance value measurement processing by cutting off the electric power supplied to the heater 112, and moves to step S37 in the main routine. The MC 401 monitors in step S37 whether the FDRVO signal becomes "TRUE" or not, and waits till this signal becomes "TRUE". Herein, the MC 401 waits for the FDRVO signal, and waits and sees whether the normal heater drive processing is executed or not. When the FDRVO signal becomes "TRUE", the MC 401 moves to step S38, and executes the slow-up sequence. This slow-up sequence is the same as the processing in steps S5–S10 in the first embodiment discussed above. That is, the heater 112 is gradually heated up by slowly increasing the value of the data PWMDATA (0 . . . 7), thereby preventing the rush current from flowing to the heater 112.

Note that the reason why the heater resistance value measurement processing in FIG. 11 has none of a particular description of the slow-up sequence, is that this heater resistance value measurement process is not performed on the user's side. Accordingly, in the heater resistance value measurement processing, there is not problem if the heater 112 is started up comparatively fast, and there is no necessity of being aware of a flicker caused by the rush current of the heater 112.

Then, the MC 401, after finishing the slow-up sequence, moves to step S39, wherein the MC 401 executes voltage adjustment processing. The voltage adjustment processing is repeatedly executed till the FDRVO signal becomes "FALSE" in step S40. If the FDRVO signal becomes "FALSE", the MC 401 halts the execution of the processing in step S39, and executes post-processing in steps S41–S43. Herein, the MC 401 resets the internal counter 1 and the data PWMDATA (0 . . . 7) to "0", and sets the RST signal to "TRUE". The drive of the FET 108 is thereby set OFF.

Now, for the duration of "TRUE" of the FDRVO signal in step S40, the voltage adjustment processing in step S39 is repeatedly executed. This voltage adjustment processing will be explained in accordance with the heater voltage adjustment processing shown in FIG. 12.

At first, in step S71, a value of the data DVDATA (0 . . . 7) is measured, Next, the MC 401 judges whether the value of the data DVDATA (0 . . . 7) is equal to or larger or smaller than the value DVREF stored on the EEPROM 401d (steps S72, S73). If the DVDATA (0 . . . 7)=DVREF, the MC 401 moves to step S76 while executing nothing. If the DVDATA (0 . . . 7)>DVREF, the MC 401 moves to step S74 and decrements the value of the data PWMDATA (0 . . . 7) by 1. If the DVDATA (0 . . . 7)<DVREF, the MC 401 moves to step S74 and increments the value of the data PWMDATA (0 . . . 7) by 1.

In step S76, the MC 401, after waiting for only the predetermined time T2, terminates the heater voltage adjustment processing.

As this processing is repeated, the value of the data DVDATA (0 . . . 7) converges so as to be substantially equal to the value DVREF. Judging from the result, the value of the data DVDATA (0 . . . 7) becomes the value DVREF in the same way as when executing the heater resistance value measurement processing. What is herein important is that even if the voltage of the AC power supply 101 slightly fluctuates in the midst of the heater voltage adjustment processing, the voltage applied to the heater 112 becomes equal to the heater voltage set in the heater resistance value adjustment processing. This implies that even when the voltage of the AC power supply 101 fluctuates, the electric power supplied to the heater 112 comes to the fixed value and remains stable. Namely, once the heater resistance value measurement processing is executed in the factory, the electric power applied to the heater 112 thereafter remains unchanged even if the AC input voltage fluctuates.

Thus, according to the second embodiment, the electric power supplied t the heater can be stabilized to the predetermined value even when there are the lot dispersion in the heater resistance value and besides the dispersion in the AC input voltage.

Note that the object of the present invention is, as a matter of course, accomplished by supplying the system or the apparatus with a storage medium stored with software program codes for actualizing the functions in the respective embodiments discussed above, and making a computer (or a CPU and a MPU) of the system or the apparatus read and execute the program codes stored on the storage medium.

In this case, the program codes themselves read from the storage medium actualize the novel functions of the present invention, and the storage medium stored with the program codes constitutes the present invention.

The storage medium for supplying the program codes can involve the use of, for example, a flexible disk, a hard disk, a magneto-optical disk, a CD-ROM, a CD-R, a CD-RW, a DVD-ROM, a DVD-RAM, a DVD-RW, DVD+RW, a magnetic tape, a nonvolatile memory card, and a ROM. Moreover, the program codes may also be supplied from a server computer via communication networks.

Furthermore, the functions according to the embodiments discussed above are actualized by the computer executing the readout program codes, and besides the present invention, as a matter of course, includes a case where an OS (operating system) or the like working on the computer performs a part or entire processes in accordance with instructions of the program codes and actualizes the functions according to the embodiments discussed above.

Furthermore, as a matter of course, the present invention also includes a case where, after the program codes read from the storage medium have been written in a function extension board inserted into the computer or in a memory provided in a function extension unit connected to the computer, a CPU or the like provided in the function extension board or the function extension unit performs a part or entire process in accordance with the instructions of the program codes and actualizes the functions of the embodiments discussed above.

What is claimed is:

1. A heater drive circuit comprising:

full-wave rectifying means for full-wave-rectifying an AC power supply;

current detecting means for detecting a current supplied from the AC power supply to the full-wave rectifying means;

a switching converter for converting the full-wave-rectified voltage from said full-wave-rectifying means into a voltage supplied to a heater to be driven;

voltage detecting means for detecting the voltage applied to said heater; and heater control means for controlling said switching converter on the basis of the current value detected by said current detecting means and the voltage value detected by said voltage detecting means.

2. A heater drive circuit according to claim 1, further comprising filter means for removing a high frequency component contained in a switching output by said switching converter, wherein the full-wave-rectified voltage subjected to switching at the high frequency is applied to said heater through said filter means.

3. A heater drive circuit according to claim 1, wherein said voltage detecting means detects an average value or a peak value of the voltage applied to the heater.

4. A heater drive circuit according to claim 3, wherein said current detecting means is constructed of a current transformer interposed in series in the AC power supply and a rectification circuit connected to an output winding of the current transformer.

5. A heater drive circuit according to claim 3, wherein said switching converter includes a switching transistor and a current retaining diode connected to said switching transistor, and changes an ON/OFF duty of said switching transistor.

6. A heater drive circuit according to claim 5, wherein said heater control means gradually increases the ON/OFF duty when starting an operation of the heater as set ON from OFF, and controls the ON/OFF duty so that the current value detected by said current detecting means is held to a predetermined value at a point of time when predetermined or longer time elapses since starting of an operation.

7. A heater drive circuit according to claim 5, further comprising storage means for storing the voltage value detected by said voltage detecting means when controlling the ON/OFF duty of said switching converter so that the current value detected by said current detecting means comes to a predetermined value in a state where the voltage value on the AC power supply line is fixed to a predetermined value, wherein said switching converter, when a predetermined condition is met, controls the ON/OFF duty so that the voltage value detected by said voltage detecting means is equalized to the voltage value stored on said storage means or to a value corresponding to the voltage value.

8. A heater drive circuit according to claim 7, wherein the predetermined condition is a condition that the heater drive circuit be utilized by a user.

9. A heater drive circuit according to claim 1, wherein an image formed on an image bearing member is thermally fixed by said heater driven by the heater drive circuit.

10. An image forming apparatus including a fixing device comprising a heater drive circuit according to claim 9.

11. A heater drive circuit comprising:

a full-wave rectifier for full-wave-rectifying an AC power supply;

a current detector for detecting a current supplied from an AC power supply to said full-wave rectifier;

a switching converter for converting the full-wave-rectified voltage from said full-wave rectifier into a voltage supplied to a heater to be driven;

a voltage detector for detecting the voltage applied to said heater to be driven; and a heater control unit for controlling said switching converter on the basis of the current value detected by said current detector and the voltage value detected by said voltage detector.

12. A heater drive circuit according to claim 11, further comprising a filter circuit for removing a high frequency component contained in a switching output by said switching converter, wherein the full-wave-rectified voltage subjected to switching at the high frequency is applied to said heater through said filter circuit.

13. A heater drive circuit according to claim 11, wherein said voltage detector detects any one of an average value and a peak value of the voltage applied to the heater.

14. A heater drive circuit according to claim 13, wherein said current detector is constructed of a current transformer interposed in series in the AC power supply and a rectification circuit connected to an output winding of said current transformer.

15. A heater drive circuit according to claim 13, wherein said switching converter includes a switching transistor and a current retaining diode connected to said switching transistor, and changes an ON/OFF duty of said switching transistor.

16. A heater drive circuit according to claim 15, wherein the heater control unit gradually increases the ON/OFF duty when starting the drive of the heater as set ON from OFF, and controls the ON/OFF duty so that the current value detected by said current detector is held to a predetermined value at a point of time when predetermined or longer time elapses since the start of the operation.

17. A heater drive circuit according to claim 15, further comprising a storage device for storing the voltage value detected by said voltage detector when controlling the ON/OFF duty of said switching converter so that the current value detected by said current detector comes to a predetermined value in a state where the voltage value on the AC power supply line is fixed to a predetermined value, wherein said switching converter, when a predetermined condition is met, controls the ON/OFF duty so that the voltage value detected by said voltage detector is equalized to the voltage value stored on said storage device or to a value corresponding to the voltage value.

18. A heater drive circuit according to claim 17, wherein the predetermined condition is a condition that said heater drive circuit be utilized by a user.

19. A fixing device comprising:

said heater drive circuit of claim 11; and a heater driven by said heater drive circuit, wherein an image formed on an image bearing member is thermally fixed by said heater drive circuit and said heating heater.

20. An image forming apparatus including the fixing device of claim 19, wherein an image formed on an image bearing member is thermally fixed by said fixing device.

* * * * *

UNITED STATES PATENT AND TRADEMARK OFFICE

CERTIFICATE OF CORRECTION

PATENT NO. : 7,145,111 B2
APPLICATION NO. : 10/809360
DATED : December 5, 2006
INVENTOR(S) : Kenjiro Hori It is certified that error appears in the above-identified patent and that said Letters Patent is hereby corrected as shown below:

ON THE TITLE PAGE, AT ITEM (56), RC:
Foreign Patent Documents, "61-35555 5/1994" should read --61-35555 2/1986--.

COLUMN 5:
Line 57, "characterizes" should read --characterize--.

COLUMN 9:
Line 12, "counters" should read --counter--.

COLUMN 10:
Line 28, "O..." should read --0...--.

COLUMN 11:
Line 24, "so is" should read --this is the case--.

COLUMN 14:
Line 39, "t the" should read --to the--.

Signed and Sealed this

Fourth Day of September, 2007

JON W. DUDAS
*Director of the United States Patent and Trademark Office*